US007147723B2

(12) United States Patent
Unagami

(10) Patent No.: US 7,147,723 B2
(45) Date of Patent: Dec. 12, 2006

(54) METHOD AND ASSEMBLY FOR STATIC ELIMINATION OF CLEANING OBJECT IN CLEARING APPARATUS

(75) Inventor: Masaki Unagami, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 430 days.

(21) Appl. No.: 10/634,435

(22) Filed: Aug. 5, 2003

(65) Prior Publication Data

US 2004/0025902 A1 Feb. 12, 2004

(30) Foreign Application Priority Data

Aug. 7, 2002 (JP) ..... 2002-229380

(51) Int. Cl.
*B08B 7/04* (2006.01)

(52) U.S. Cl. ..... 134/7; 134/18; 134/201

(58) Field of Classification Search ..... 134/6, 134/7, 18, 34, 301; 15/1.51, 300.1, 344
See application file for complete search history.

(56) References Cited

U.S. PATENT DOCUMENTS 4,378,610 A * 4/1983 Ermer et al. ..... 15/1.51
5,364,472 A * 11/1994 Heyns et al. ..... 134/7
5,409,418 A * 4/1995 Krone-Schmidt et al. ..... 451/75
5,651,834 A * 7/1997 Jon et al. ..... 134/31
5,837,064 A * 11/1998 Bowers ..... 134/6
5,928,434 A * 7/1999 Goenka ..... 134/2
6,103,016 A * 8/2000 Jon et al. ..... 134/2
6,282,812 B1 * 9/2001 Wee et al. ..... 34/464
6,524,394 B1 2/2003 Okazawa et al.
6,972,967 B1 * 12/2005 Norte et al. ..... 361/818

FOREIGN PATENT DOCUMENTS

JP 2001-60794 3/2001
JP 2002-172368 6/2002

* cited by examiner

*Primary Examiner*—Alexander Markoff
(74) *Attorney, Agent, or Firm*—Morgan & Finnegan, LLP

(57) ABSTRACT

There is disclosed a method for static elimination of a cleaning target in a cleaning step is carried out by disposing in a cleaning apparatus a conducting means capable of coming into contact with and separating from the cleaning target at a plurality of portions thereof, bringing the conducting means into contact with the plurality of portions of the cleaning target, and eliminating, by grounding via the conducting means, the static electrification on the cleaning target that is caused by a cleaning member during cleaning. A static elimination assembly carrying out this method is also disclosed.

4 Claims, 2 Drawing Sheets

METHOD AND ASSEMBLY FOR STATIC ELIMINATION OF CLEANING OBJECT IN CLEARING APPARATUS

BACKGROUND OF THE INVENTION

1. Field of the Invention

This invention relates to a method for static elimination of a cleaning target in the above cleaning target cleaning method. More particularly, this invention relates to a static elimination method for removing static electricity from a cleaning target in a method of cleaning the cleaning target by spraying a cleaning agent as in the case of blast cleaning. This invention still also relates to a static elimination assembly in a cleaning apparatus.

2. Related Background Art

Image-forming apparatus such as copying machines and printers and information equipment such as computers have been distributed in a large quantity, and reuse systems which use such apparatus and equipment recyclingly are being established. In the recycling of such equipment, it is necessary to clean electric assembly parts and units in the equipment.

For example, in image-forming apparatus making use of toners, it is required that the contamination due to toner in the equipment is removed by cleaning. The contamination due to toner involves strong adhesion of contaminants, where a cleaning method making use of cleaning water or surface-active agents of detergents and a method such as blast cleaning are employed.

A cleaning method making use of dry ice is proposed as disclosed in, e.g., U.S. Pat. No. 6,524,394 (corresponding to Japanese Patent Application Laid-Open No. 2002-172368, laid open on Jun. 18, 2002). When cleaning targets are cleaned by spraying dry ice against them as in U.S. Pat. No. 6,524,394, it is necessary to prevent the electric assembly parts and units from charging static electricity.

Japanese Patent Application Laid-Open No. 2001-60794 discloses an invention of an apparatus for fitting a surface mount component part. What is configured in this publication is surface mount fitting in which, with reference to a drawing attached to the publication, an electronic component part b in a feed section m is held with a holding member 2 of a fitting head 1 and then transported from the feed section m to a fitting section n so that the electronic component part b is fitted to a stated position of a substrate c in this fitting section n. It discloses a proposal in which the fitting head 1 or a movable member 9 fitted with the fitting head 1 is provided with a static elimination means 15, and the holding means 2 and the electronic component part b held with the holding means 2 are static-eliminated by the static elimination means 15 in the course where the electronic component part b is transported from the feed section m to the fitting section n.

The static elimination means is configured as described in column 0020 of the publication, and is a means for removing static electricity by spraying ionized air on the holding means 2 and the electronic component part b held with the holding means 2.

SUMMARY OF THE INVENTION

The present invention was made taking account of the above subject concerning static elimination. Accordingly, an object of the present invention is to provide a static elimination method for preventing a cleaning target from charging static electricity when the cleaning target is cleaned.

Another object of the present invention is to provide a static elimination assembly which carries out static elimination, preferably used in the blast cleaning.

To settle the above subject and achieve the above objects, the present invention provides, a method for static elimination of a cleaning target in a cleaning step, the method comprising the steps of:

disposing in a cleaning apparatus a conducting means capable of coming into contact with and separating from the cleaning target at a plurality of portions thereof;

bringing the conducting means into contact with the plurality of portions of the cleaning target; and eliminating, by grounding via the conducting means, the static electrification on the cleaning target that is caused by a cleaning member during cleaning.

As a preferred embodiment, in the above method, the conducting means may comprise a plurality of conducting members capable of advancing and retreating.

An embodiment is also provided in which the conducting members are in the shape of pins.

As the static elimination assembly, the present invention also provides, a static elimination assembly for performing static elimination of a cleaning target in a cleaning apparatus, the assembly comprising:

a conducting means capable of coming into contact with and separating from a cleaning target at a plurality of portions thereof which is disposed in the cleaning apparatus;

a means for bringing the conducting means into contact with, and separating the same from, the plurality of portions of the cleaning target; and a grounding means connected to the conducting means.

As a preferred embodiment of the static elimination assembly, the conducting means may comprise a plurality of conducting members capable of coming into contact with the plurality of portions of the cleaning target.

An embodiment is also provided in which the conducting members are in the shape of pins.

An embodiment is further provided in which the conducting means comprises a plurality of conducting members and a holding member which holds the conducting members in such a way that they are capable of advancing and retreating.

DESCRIPTION OF THE PREFERRED EMBODIMENTS

Preferred embodiments of the present invention are described below with reference to the accompanying drawings.

Figure 1:
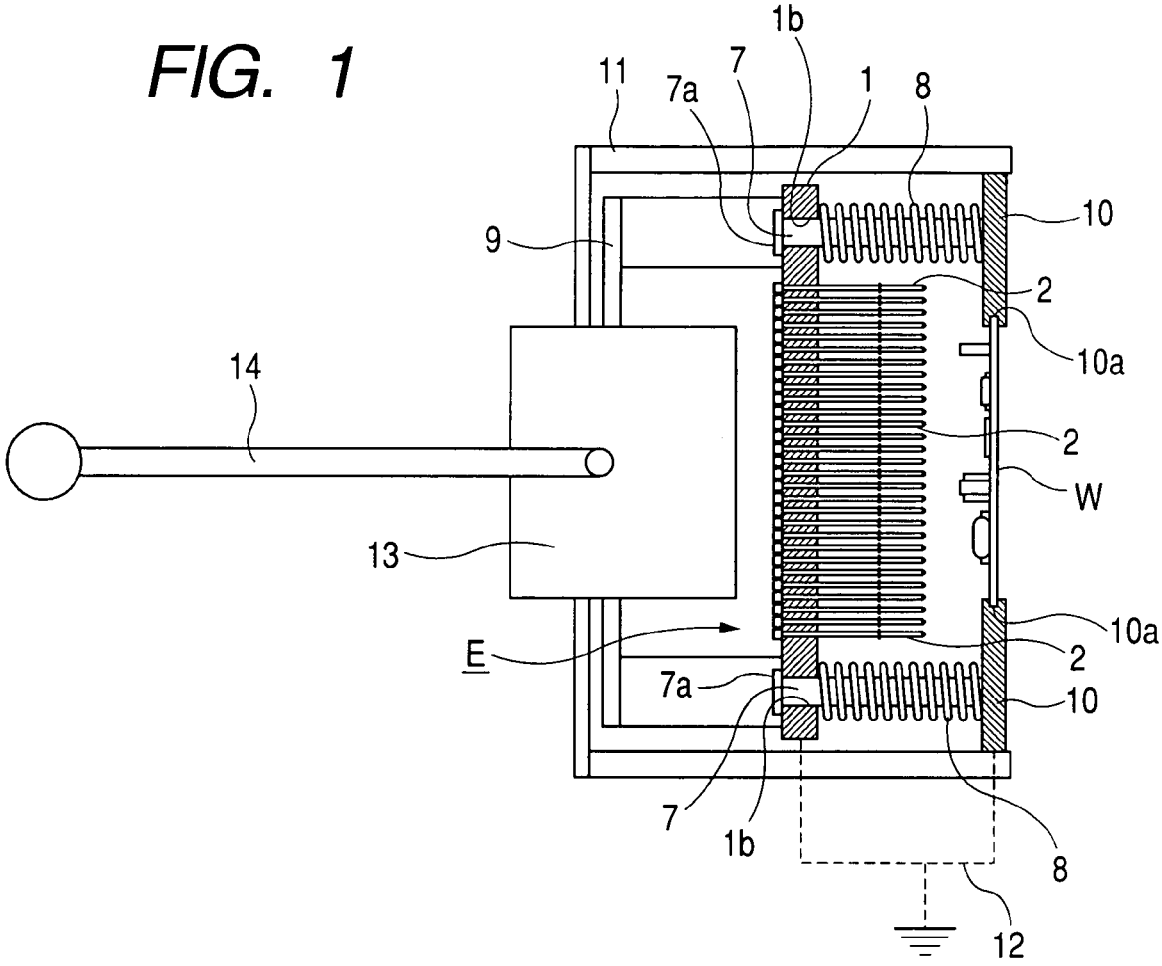
FIG. 1 is a diagram showing the configuration of a static elimination assembly representing characteristic features of the present invention.

As shown in FIG. 1, the static elimination assembly of the present invention is chiefly constituted of:

a pair of holding members 10 serving as a holding means which holds a cleaning target W of electronic equipment (in this example, a printed circuit board which had constituted an electronic circuit set in an image-forming apparatus);

a static elimination unit E which has a substrate 1 having conductivity and a plurality of members 2 having conductivity which are so arranged on the substrate as to be spaced apart each other; and a movement means 13 for moving the static elimination unit E forward and backward.

The holding members 10 are provided opposing to each other on a fixing frame 11 on its one end side, and are holded by fitting both sides of the cleaning target W in a groove-like fitting portion 10*a*.

The static elimination assembly shown in FIG. 1 is disposed in a cleaning apparatus such as a blast cleaning apparatus, and the fixing frame 10 holds the cleaning target of the cleaning apparatus.

Figure 2:
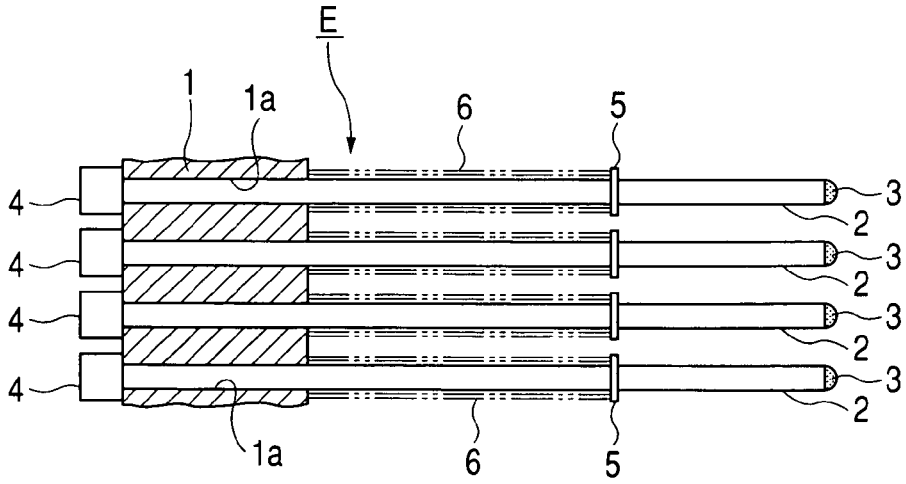
FIG. 2 is a diagram showing the configuration of a conducting means.

As shown in FIG. 2, the static elimination unit E has, as the above substrate 1, a conductive substrate 1 grounded via a ground lead of the cleaning apparatus, a plurality of through holes 1*a* so provided in the substrate 1 as to be spaced apart each other, and, as the above members 2, conductive pins 2 inserted and held in the respective through holes 1*a* and so arranged as to be freely movable in the axial direction.

The pins 2 are integrally provided on one end thereof with contact points 3 having an elasticity and made of conductive rubber or the like. The pins 2 are also provided on the other end thereof with stoppers 4 for preventing the pins from coming out.

Springs 6 as cushioning means are also provided between the substrate 1 and guard fringes 5 at substantially the middle portion in the lengthwise direction of the pins 2, and the pins 6 are so arranged as to stand by in the state the stoppers 4 are kept in contact with the substrate 1 on its side opposite to the cleaning target.

The static elimination unit E is guided by guide members 7 inserted to guide holes 1*b* provided at positions vicinal to the peripheral portions (e.g., at positions vicinal to four corners) of the substrate 1, and is set movable forward and backward with respect to the cleaning target W held with the holding members 10, where the static elimination unit E stands by at a position the tips of the pins 2 are kept apart from the cleaning target W by the action of springs 8 set between the substrate 1 and the holding members 10.

Figure 3:
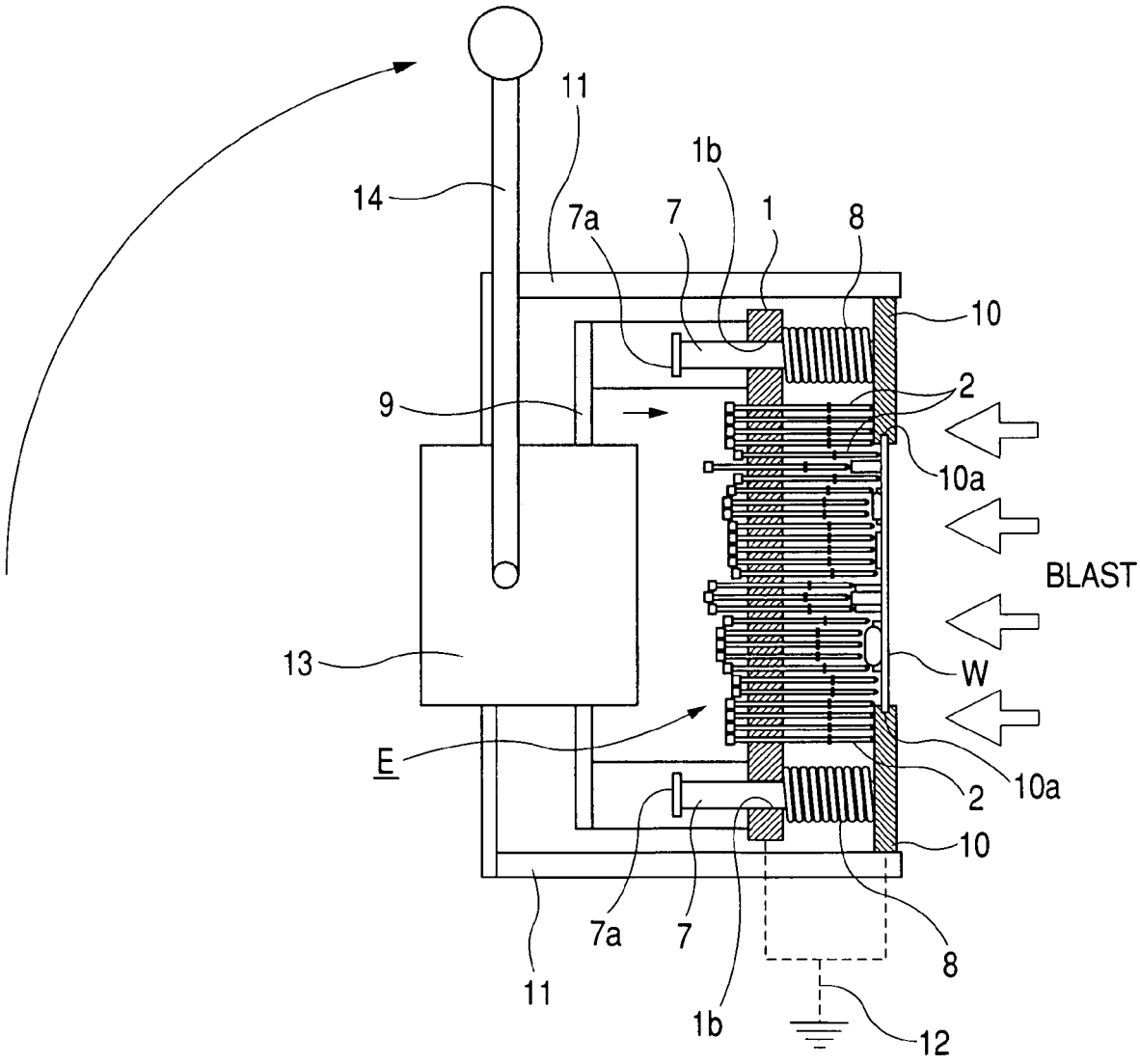
FIG. 3 illustrates how to operate static elimination.

The movement means 13 is disposed at the other end of the fixing frame 11, and an operating lever 14 may be turned from the position it stands as shown in FIG. 1 to the position shown in FIG. 3, to make operation. The static elimination unit E may be made to move forward via a movement frame member 9 by means of a cam mechanism or link mechanism interlocked with the operating lever 14, to bring the contact points 3 of the pins 2 into contact with the plurality of portions of the printed circuit board which is a cleaning target.

In the present invention, as the movement means 13, any means such as an oil pressure means, an air pressure means or a motor drive means may appropriately be employed. It is also effective to connect the pins 2 to a straight-line drive means such as a fluid pressure cylinder or a motor drive cylinder so that the pins 2 can be made to move independently via the straight-line drive means.

A method for the static elimination of the cleaning target in dry-process blast cleaning according to the present invention is described below.

As shown in FIG. 1, the cleaning target printed circuit board W is held with the holding member 10 of the holding means. Then, the operating lever 14 is turned to make the movement frame member 9 move backward to make the static elimination unit E stand by at the position it is kept stood by.

Next, as shown in FIG. 3, the operating lever 14 is turned to make the static elimination unit E move together with the movement frame member 9 against the spring force of the springs 8 toward the surface of the cleaning target printed circuit board W 8. Thus, the contact points 3 of the plurality of pins 2 come into contact with the plurality of portions of the printed circuit board W. The respective pins 2 change in their length of projection from the substrate 1, corresponding to unevenness of the contact portions on the printed circuit board W. As the result, the pins' contact points 3 are kept in that contact by the contact pressure corresponding to the spring force of the spring 6.

Cleaning is carried out after the operation to bring the pins' contact points 3 into contact with the stated portions of the printed circuit board has been completed. In the cleaning action of the cleaning apparatus, when, e.g., the fixing frame 11 holding the static elimination unit E and so forth is set in a dry ice cleaning apparatus and the toner adhering to the printed circuit board is removed by cleaning with a dry ice cleaning agent, the static electricity generated in the printed circuit board because of the action of dry ice particles colliding against it flows to the ground lead 12 via the pins 2 to come eliminated.

As described above, in the present invention, the conducting means capable of coming into contact with and separating from the cleaning target at a plurality of portions thereof is disposed in a cleaning apparatus, the conducting means is brought into contact with the plurality of portions of the cleaning target, and the static electrification on the cleaning target that is caused by a cleaning member during cleaning is eliminated by grounding via the conducting means. Thus, the static elimination in the step of cleaning the electronic equipment or component parts can effectively be performed, and hence any harm to the cleaning target can be prevented.

Since also the static elimination means is constituted of a plurality of conducting members capable of advancing and retreating and the conducting means are so arranged as to come into contact with the plurality of portions of the cleaning target, the static elimination action can be made sure in the blast cleaning of the cleaning target.

Moreover, since the static elimination means is so configured that the pressure of contact of the plurality of conducting members constituting it with the cleaning target can uniformly be applied, the static elimination action on individual portions of the cleaning target can be made sure.

What is claimed is:

1. A method for static elimination of a cleaning target in a cleaning step, the method comprising the steps of:

disposing in a cleaning apparatus a conducting means capable of coming into contact with and separating from the cleaning target at a plurality of portions thereof, the conducting means comprising a plurality of conducting members each having a shape of a pin and a substrate which holds the conducting members in such a way that they are capable of advancing and retreating in a direction substantially perpendicular to the cleaning target;

moving the conducting members substantially perpendicular to the cleaning target such that the conducting members come into contact with the plurality of portions of the cleaning target;

maintaining contact between the conducting members and the plurality of portions of the cleaning target; and eliminating, by grounding via the conducting means, the static electrification on the cleaning target that is caused by a cleaning member during cleaning.

2. A static elimination assembly for performing static elimination of a cleaning target in a cleaning apparatus, the assembly comprising:

a conducting means disposed in the cleaning apparatus, comprising a plurality of conducting members each having a shape of a pin and a substrate which holds the conducting members in such a way that they are capable of advancing and retreating in a direction substantially perpendicular to a cleaning target, wherein the plurality of conducting members are capable of coming into contact with and separating from a the cleaning target at a plurality of portions thereof;

a movement means for bringing the conducting members in a direction substantially perpendicular to the cleaning target and into contact with, and separating the same from, the plurality of portions of the cleaning target; a cleaning means and a grounding means connected to the conducting members for eliminating static electricity generated in the cleaning target during cleaning by the cleaning means.

3. The assembly according to claim 2, wherein the movement means move the substrate and the conducting members to portions where the contacting members come into contact with the plurality of portions of the cleaning target as the substrate is moving.

4. The assembly according to claim 3, wherein the movement means are capable of maintaining contact between the conducting members and the plurality of portions of the cleaning target.

* * * * *